US006939284B2

(12) United States Patent
Trovinger et al.

(10) Patent No.: US 6,939,284 B2
(45) Date of Patent: Sep. 6, 2005

(54) SHEET FOLDING APPARATUS WITH ROUNDED FOLD BLADE

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 42 days.

(21) Appl. No.: 09/970,840

(22) Filed: Oct. 5, 2001

(65) Prior Publication Data

US 2003/0069118 A1 Apr. 10, 2003

(51) Int. Cl.[7] ..... B31F 1/10
(52) U.S. Cl. ..... 493/434; 493/442
(58) Field of Search ..... 493/435, 434, 493/437, 442, 444, 445, 405, 395; 270/49

(56) References Cited

U.S. PATENT DOCUMENTS

| | | | | |
|---|---|---|---|---|
| 3,202,066 A | | 8/1965 | Palmer | |
| 3,398,661 A | | 8/1968 | Mathes et al. | |
| 3,434,399 A | | 3/1969 | Palmer | |
| 3,916,749 A | | 11/1975 | Armelin | |
| 3,954,258 A | * | 5/1976 | Skipor et al. | 493/445 |
| 3,978,773 A | | 9/1976 | Pinto | |
| 3,995,849 A | | 12/1976 | Kistner | |
| 4,015,838 A | | 4/1977 | Thurmann | |
| 4,041,849 A | | 8/1977 | Tsukasaki | |
| 4,053,150 A | * | 10/1977 | Lane | 493/417 |
| 4,101,121 A | | 7/1978 | Rastorguyeff | |
| 4,221,373 A | | 9/1980 | Muller Hans | |
| 4,226,410 A | | 10/1980 | McIntosh, Sr. et al. | |
| 4,265,437 A | | 5/1981 | Reist et al. | |
| 4,304,561 A | * | 12/1981 | Shingo | 493/439 |
| 4,310,326 A | | 1/1982 | Bellanca | |
| 4,496,339 A | | 1/1985 | Moll | |
| 4,557,714 A | | 12/1985 | Sabelstrom et al. | |

(Continued)

FOREIGN PATENT DOCUMENTS

| | | |
|---|---|---|
| DE | 19611787 | 9/1997 |
| WO | WO00/18583 | 4/2000 |
| WO | WO 00/18583 | 4/2000 |

OTHER PUBLICATIONS

U.S. Appl. No. 09/970,730 filed Oct. 5, 2001, entitled "Sheet Folding Apparatus" by Steven W. Trovinger et al.

U.S. Appl. No. 09/970,748 filed Oct. 5, 2001, entitled "Thick Media Folding Method" by Steven W. Trovinger et al.

U.S. Appl. No. 09/970,877 filed Oct. 5, 2001, entitled "Sheet Folding Apparatus with Pivot Arm Fold Rollers" by Steven W. Trovinger et al.

U.S. Appl. No. 10/259,458 filed Sep. 30, 2002, entitled "Method and Apparatus for Sheeting Folding" by Steven W. Trovinger et al.

U.S. Appl. No. 09/971,351 filed Oct. 5, 2001, entitled "Variable Media Thickness Folding Method" by Steven W. Trovinger et al.

*Primary Examiner*—Eugene Kim

(57) ABSTRACT

An apparatus for folding sheet material, including a fold blade having a rounded folding surface, a fold roller, and drive means for moving at least one of the fold blade and the fold roller into operable communication such that the fold roller passes around or along the rounded folding surface.

17 Claims, 10 Drawing Sheets

U.S. PATENT DOCUMENTS 4,595,187 A 6/1986 Bober
4,614,512 A 9/1986 Capdeboscq
4,643,705 A 2/1987 Bober
4,834,696 A 5/1989 Marschke
4,891,681 A 1/1990 Fiske et al.
4,893,803 A 1/1990 Petersen
5,028,193 A 7/1991 Misicka
5,080,339 A 1/1992 Hirahara
5,087,163 A 2/1992 Erdbories et al.
5,092,827 A 3/1992 McAdam, III et al.
5,114,392 A 5/1992 McAdam, III et al.
5,147,276 A 9/1992 Stab
5,169,376 A 12/1992 Ries et al.
5,190,514 A 3/1993 Galvanauskas
5,230,686 A 7/1993 McAdam, III et al.
5,242,364 A 9/1993 Lehmann
5,346,350 A 9/1994 Luhman et al.
5,377,965 A 1/1995 Mandel et al.
5,452,920 A 9/1995 Parker
5,465,213 A 11/1995 Ross
5,738,620 A 4/1998 Ebner et al.
5,803,891 A 9/1998 Haan et al.
5,937,757 A 8/1999 Jackson et al.
5,979,348 A 11/1999 Yaguchi
5,997,459 A 12/1999 Kruger et al.
6,042,529 A * 3/2000 Hubler et al. ..... 493/434
6,074,332 A * 6/2000 Helmstadter et al. ..... 493/254
6,090,032 A 7/2000 Bellanca
6,094,225 A 7/2000 Han
6,120,427 A 9/2000 Haan et al.
6,193,458 B1 2/2001 Marsh
6,363,851 B1 4/2002 Gerhard et al.

* cited by examiner

SHEET FOLDING APPARATUS WITH ROUNDED FOLD BLADE

BACKGROUND OF THE INVENTION

1. Field of the Invention

The present invention generally relates to folding sheet material and, more particularly, to a sheet folding apparatus using a fold blade that includes a rounded folding surface.

2. Background Information

Several methods for creating folds in sheet material are currently known, including the use of dual folding cylinders, as described in U.S. Pat. No. 4,053,150 (Lane), U.S. Pat. No. 4,893,803 (Peterson), and U.S. Pat. No. 4,643,705 (Bober), the disclosures of which are hereby incorporated by reference in their entireties. Another known method for folding sheet material involves the use of an in-line series of concave V-shaped pulleys, as described in U.S. Pat. No. 6,120,427 (Haan et al.), the disclosure of which is hereby incorporated by reference in its entirety. A method for folding sheet material is also described in PCT Document No. WO 00/18583 (hereafter referred to as "the Trovinger PCT"), hereby incorporated by reference in its entirety, where a fold is formed in a sheet material by reciprocating a set of fold rollers that have been placed into contact with the sheet material against a sharp-edged fold blade.

In each of these methods and associated systems, sheet material is deformed to create sharp, creased folds. However, creating products such as booklets out of sheet material containing such folds can have its disadvantages. For example, in a booklet-making environment, a condition known as "pillowing" can occur even when the booklet contains only a few sheets of material. Pillowing describes the tendency of booklet pages to spring open near the folded edge of a booklet and can be the limiting factor when designing a booklet. That is, a booklet with containing too many sharply folded sheets (depending on the material used) can possess excessive pillowing and can consequently be both difficult to handle and unsightly.

It would be desirable to create a fold that reduces pillowing and is cosmetically more appealing than a sharp fold.

SUMMARY OF THE INVENTION

The present invention is directed to an apparatus that folds sheet material using a fold blade having a rounded folding surface.

According to an exemplary embodiment of the present invention, an apparatus for folding sheet material is provided, including a fold blade having a rounded folding surface, a fold roller, and drive means for moving at least one of the fold blade and the fold roller into operable communication such that the fold roller passes at least one of around and along the rounded folding surface.

According to a second embodiment of the present invention, a method for folding a sheet of material is provided, including the steps of feeding a sheet material into an area between a fold roller and a fold blade, and moving the fold roller and the fold relative to one another to form a rounded fold in the sheet using the fold blade, wherein the fold blade includes a rounded folding surface.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE PREFERRED EMBODIMENTS

Figure 1A:
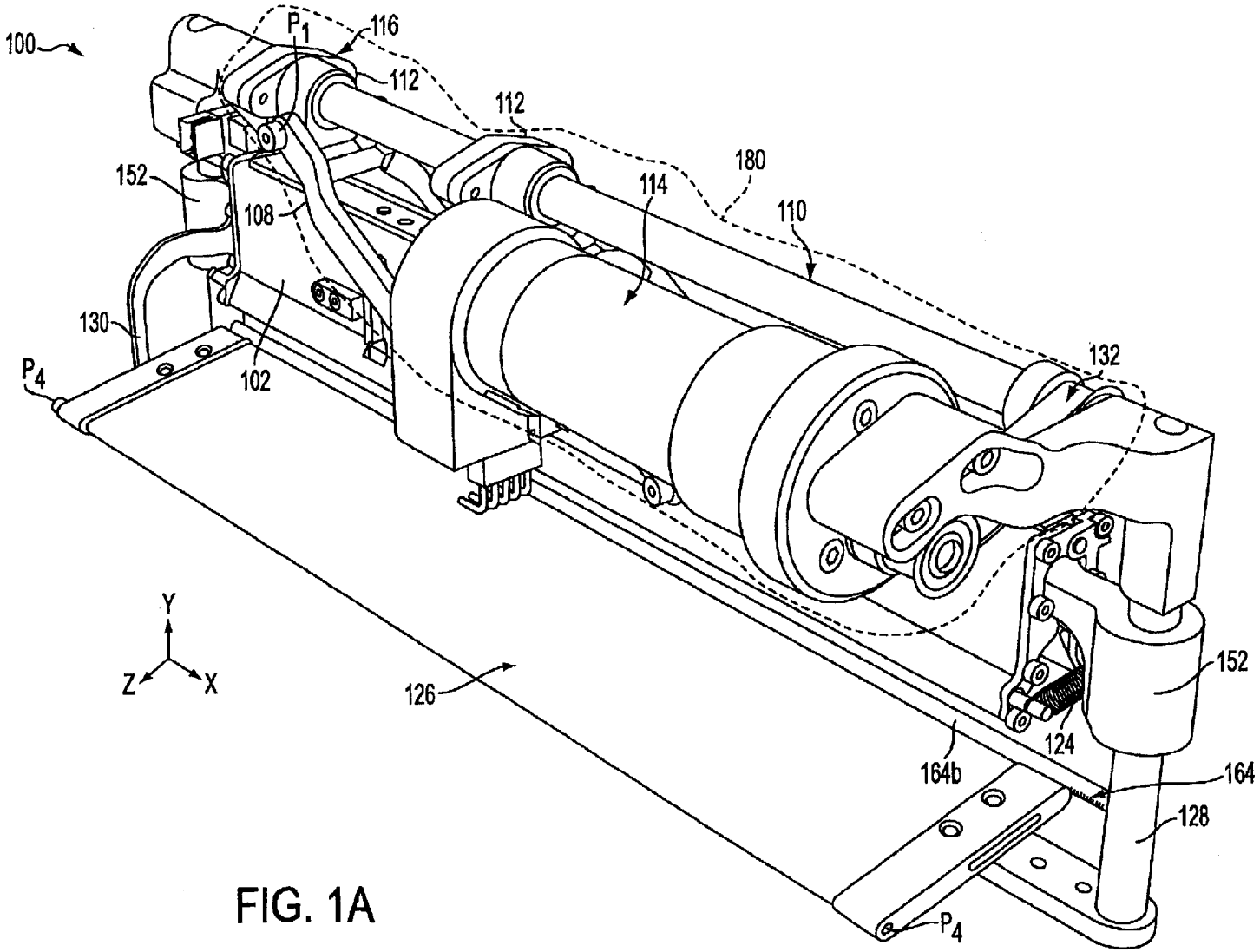
FIGS. 1A and 1B are perspective views of a sheet folding apparatus in accordance with an exemplary embodiment of the present invention.
Figure 1B:
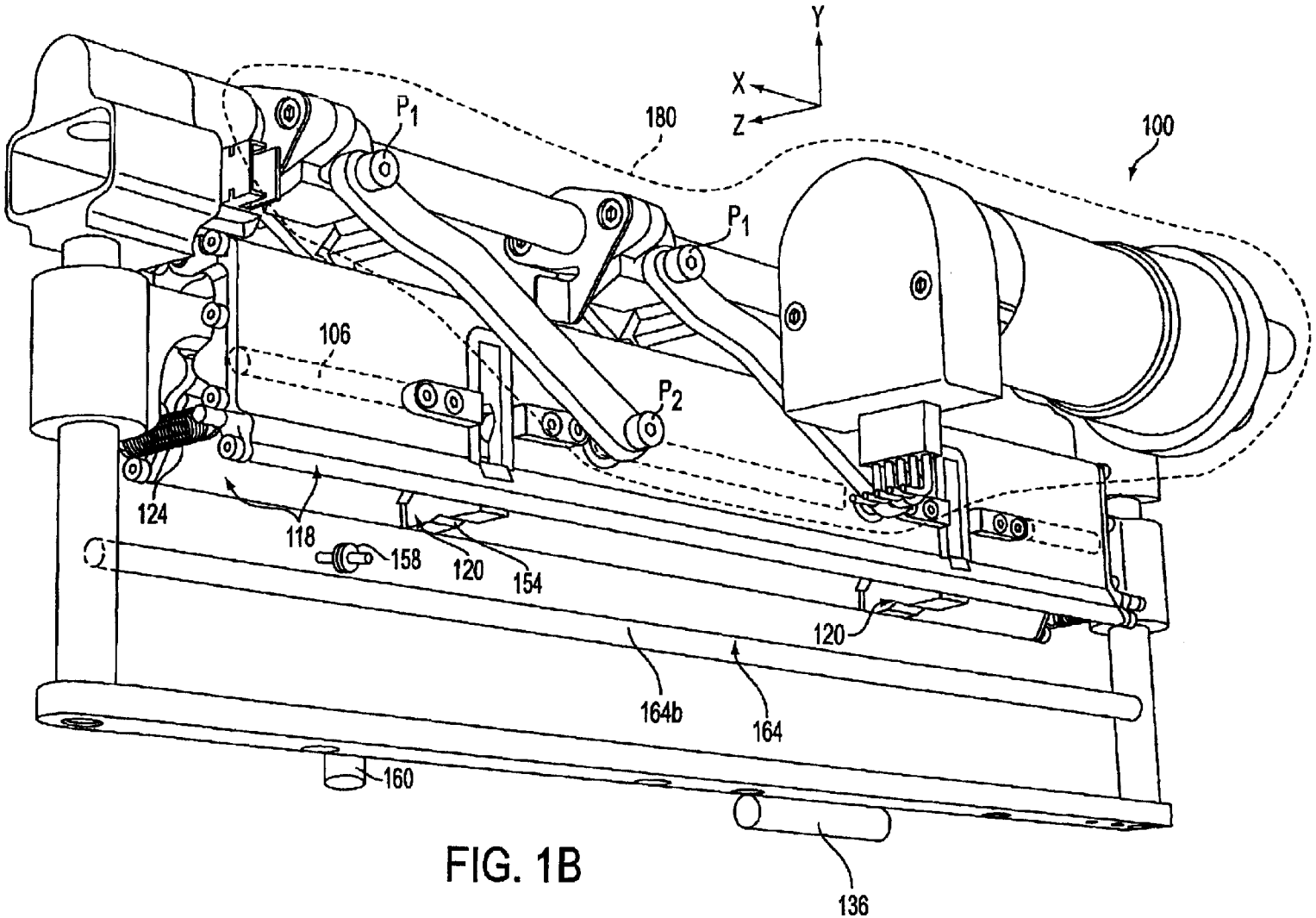

An apparatus for folding sheet material is represented as apparatus 100 in FIGS. 1A and 1B. The exemplary apparatus 100 includes a fold blade having a rounded folding surface, such as fold blade 164 having a rounded folding surface 164*b*. As referred hereon, "rounded" means having at least in part a round periphery (i.e., some radii of curvature). Fold blade 164 also has a longitudinal axis along the x-axis of FIG. 1A and is shown to be arranged as a single rod-like element, where either ends of fold blade 164 can be fixedly attached to rails 128. Alternatively, fold blade 164 can be supported by a fold blade and blade holder as described in the co-pending application Ser. No. 09/970,730 titled "Sheet Folding Apparatus", filed on even date herewith, hereby incorporated by reference in its entirety, or by any other stabilizing structure.

Fold blade 164 can be fixed or can alternatively be movable (for example, along the y-axis of FIG. 1A, or any desired axis) by using a device such as blade motor 136. For example, blade motor 136 can use gears or any other means to translate fold blade 164 along rails 128, which are longitudinally arranged in the y-axis. Such movement can be used to provide easier feeding of sheet material past fold blade 164.

Fold blade 164 can be made of metal, a polymer, or any other formable material. Folding surface 164*b* can be a component separate from fold blade 164 (e.g., detachable) and can be made of a material different from or identical to the material used to manufacture fold blade 164. As a non-limiting example, fold blade 164 can be made of a metal, while the folding surface 164*b* can be made of an elastic material.

Figure 3A:
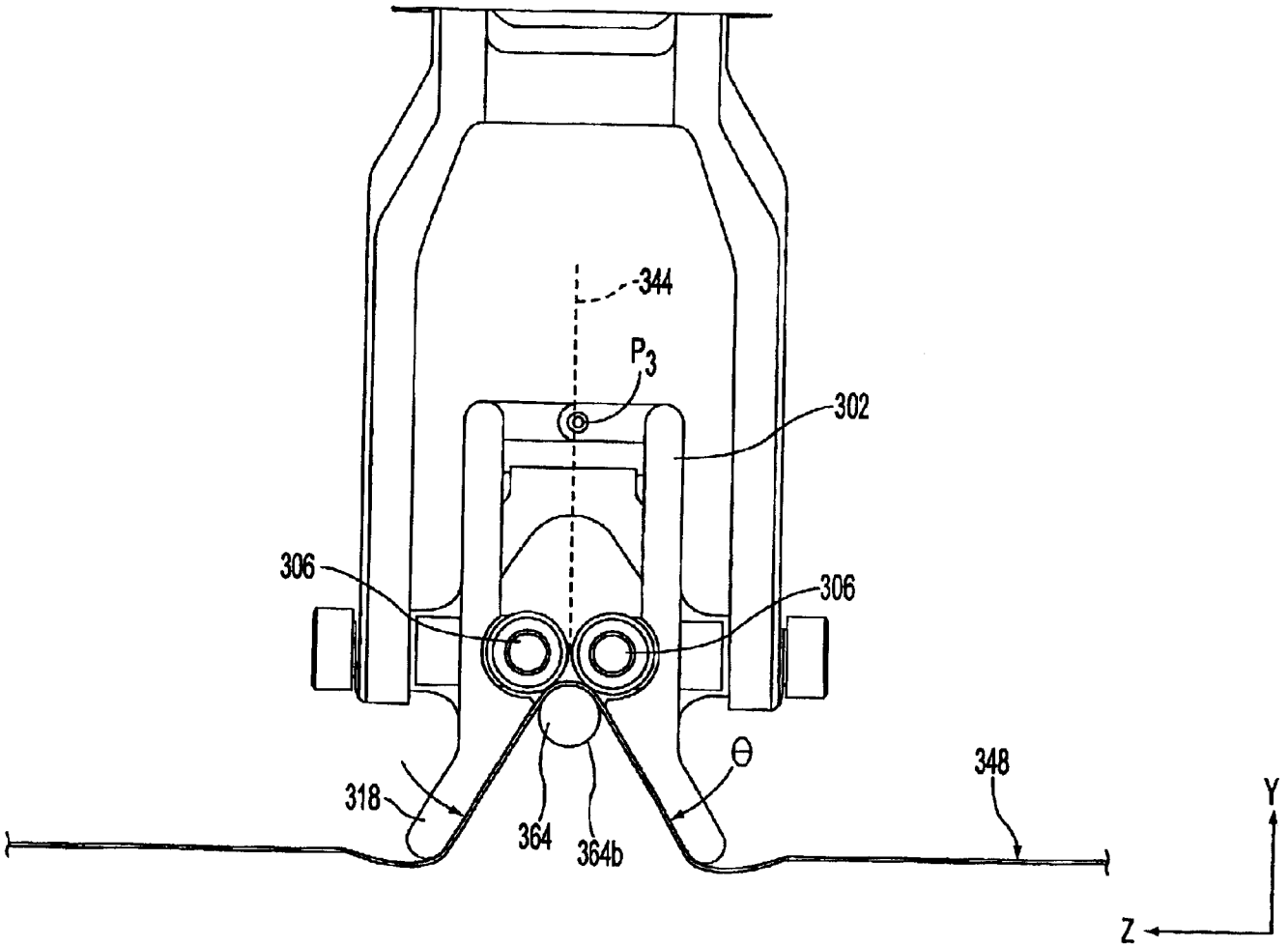
FIGS. 3A–3C illustrate a process of folding sheet material in accordance with the embodiment of FIGS. 1A and 1B.
Figures 1, 3B:
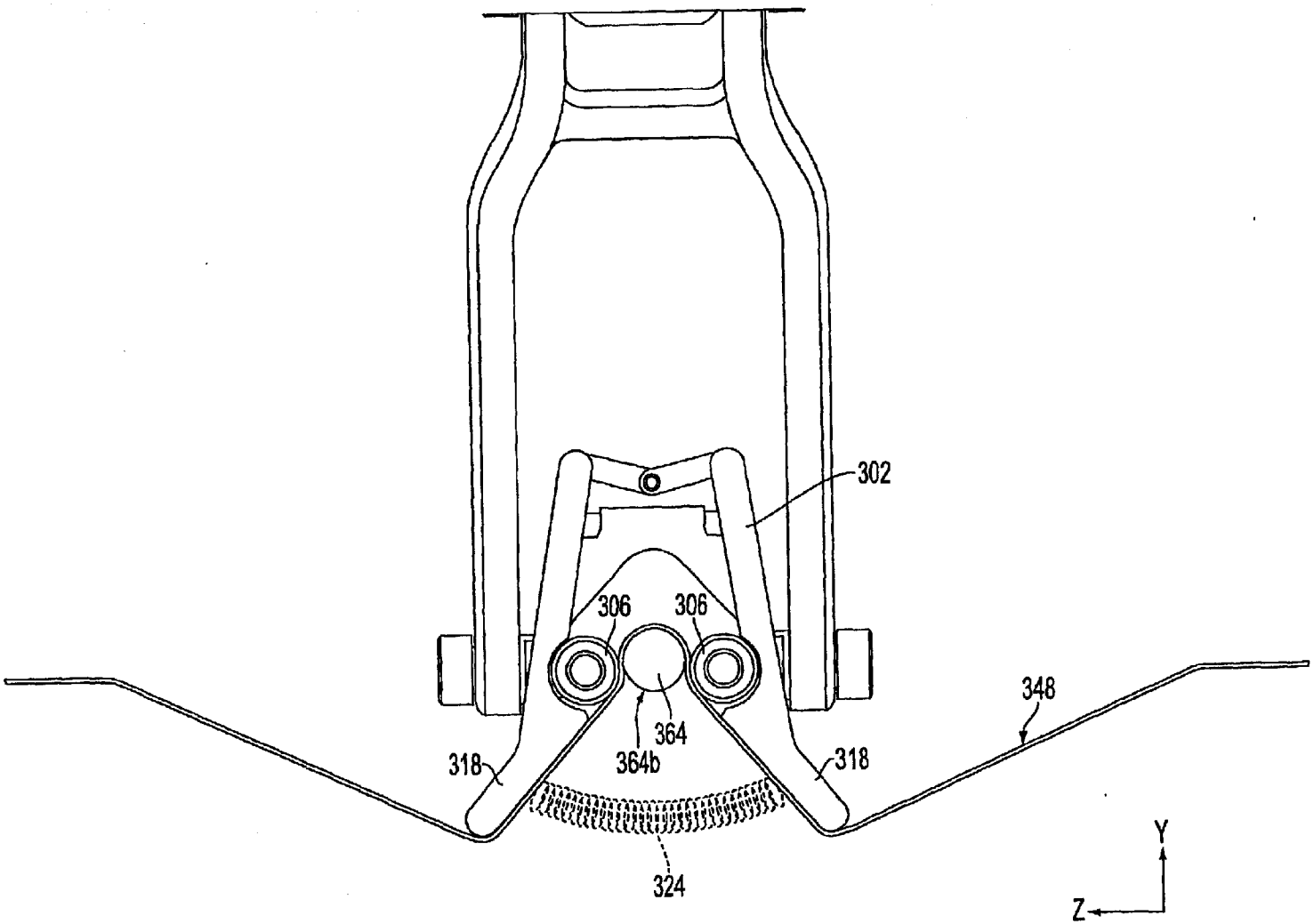
Figures 2, 3B:
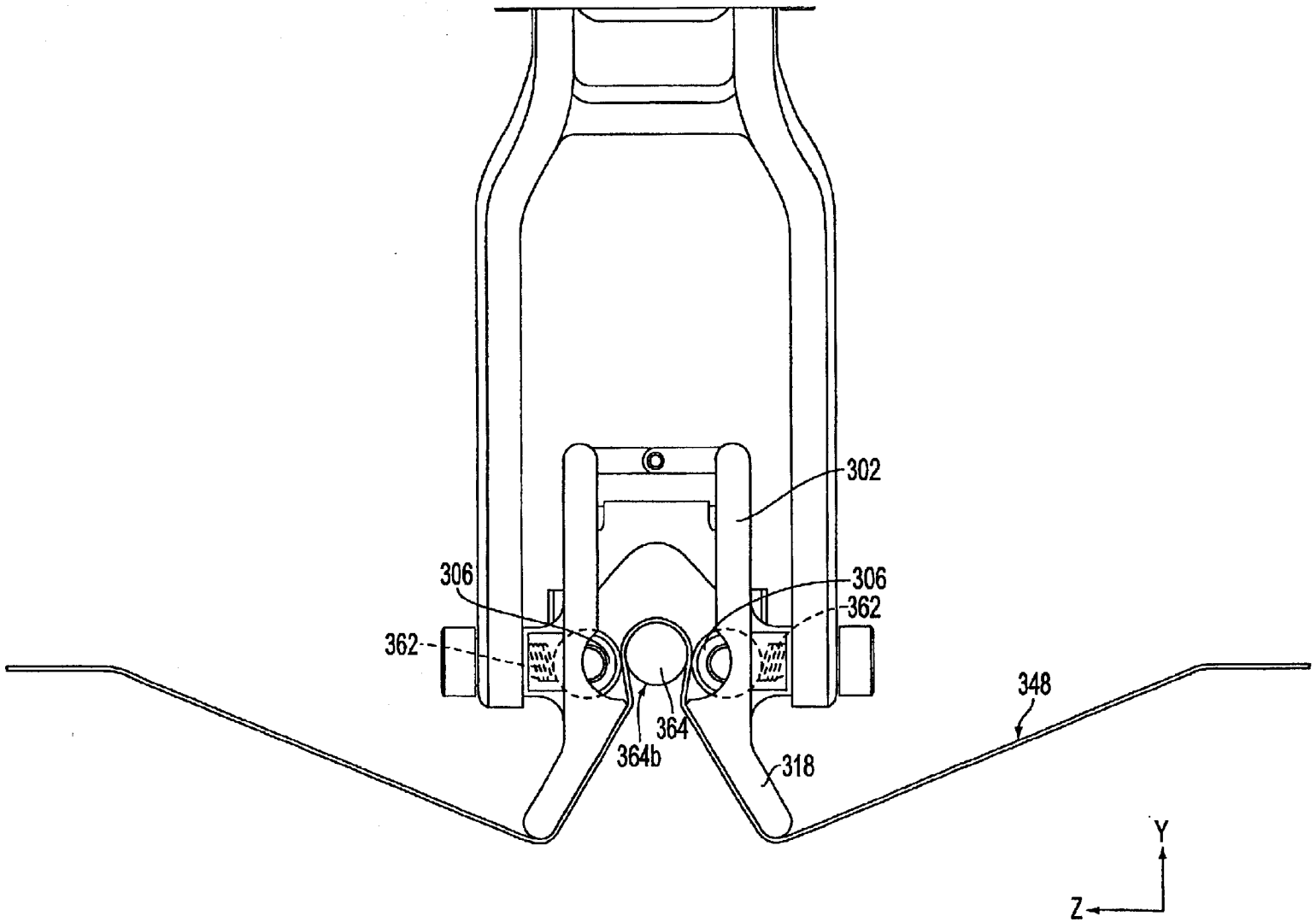
Figure 3C:
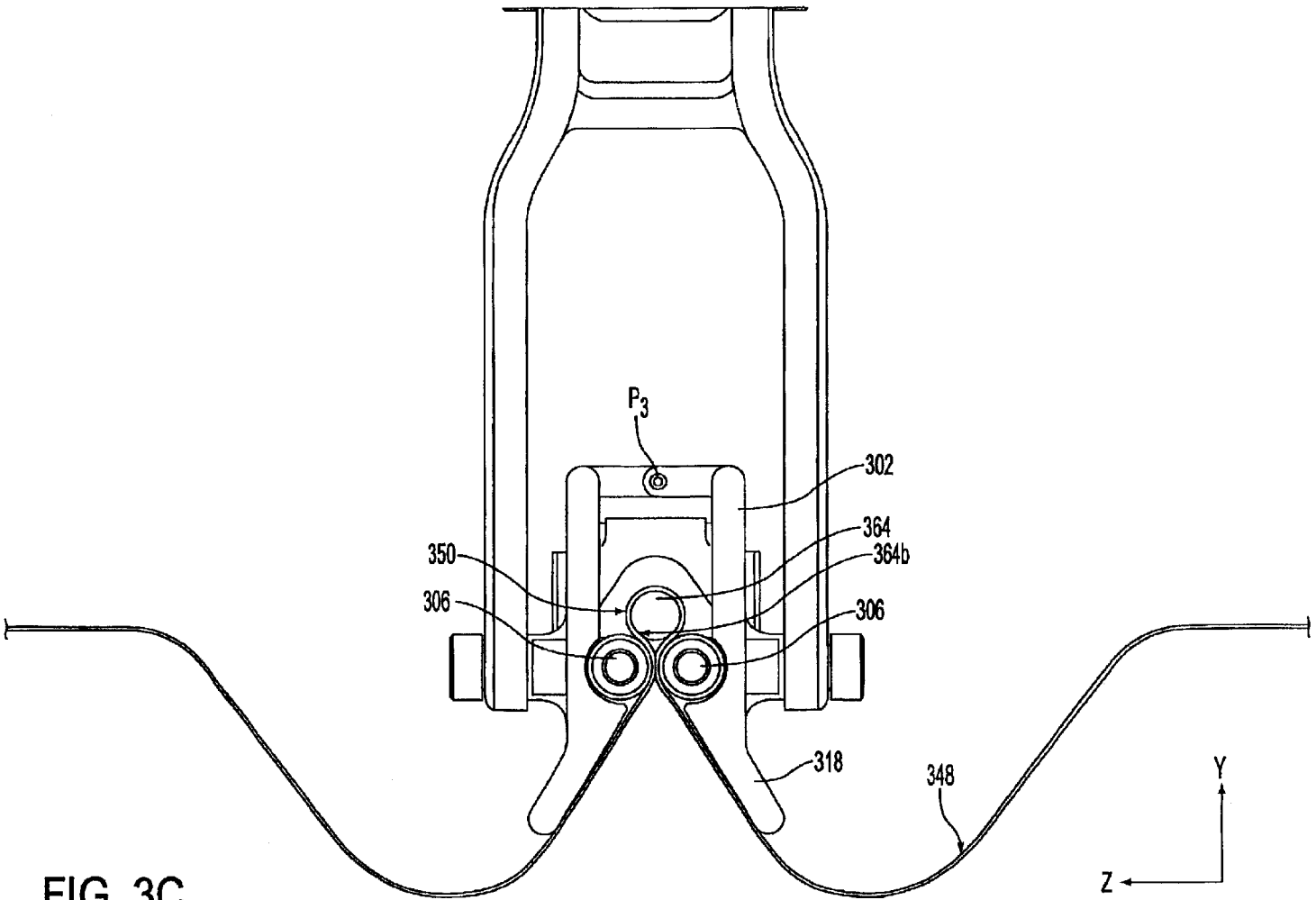
Figure 5:
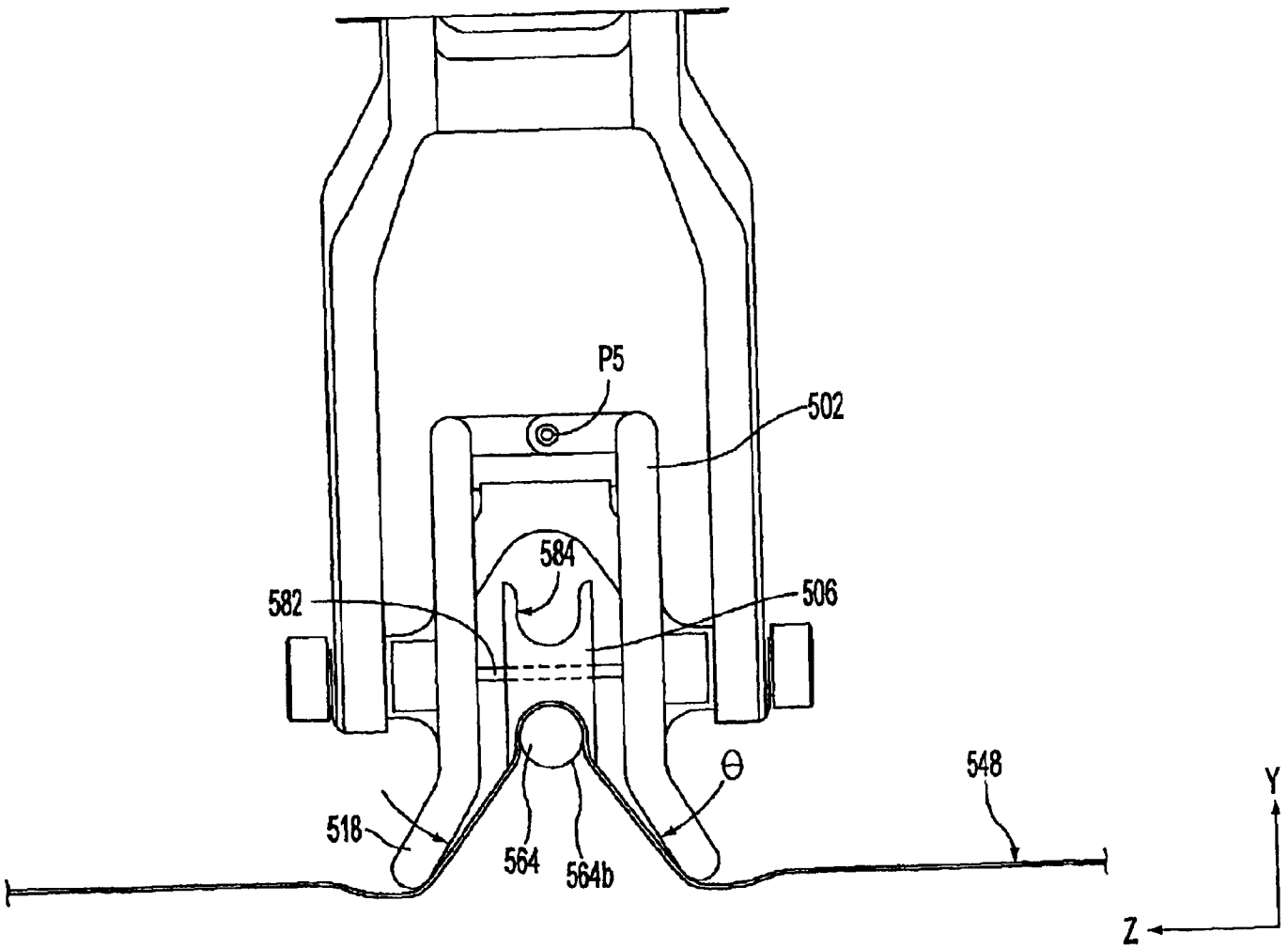
FIG. 5 illustrates a frontal view of a sheet folding apparatus in accordance with a further exemplary embodiment of the present invention.

Apparatus 100 also includes at least one fold roller, such as fold rollers 106, which are shown in FIGS. 3A–3C as two fold rollers 306, but can alternatively be of any number. As shown in FIGS. 3A–3C, fold blade 364 is positioned in a plane which passes between the two fold rollers 306. This plane is represented in FIG. 3A by dotted line 344. Each exemplary fold roller 106 rotates about an axis parallel to a longitudinal axis of fold blade 164 (i.e., the x-axis in FIG. 1A). Alternatively, apparatus 100 can include a fold roller (or fold rollers) in the form of fold roller 506 (shown in FIG. 5), which rotates about an axis perpendicular to a longitudinal axis of fold blade 564. Fold rollers 106 (and fold roller 506) can be made of metal or any other formable material, and can be coated with an elastomeric or deformable material such as an elastomer. Fold rollers 106 can be circular in cross-section (as shown in the figures), or can alternatively have any other cross-sectional shape that can operate with fold blade 164 to create a rounded fold in sheet material.

Figure 4A:
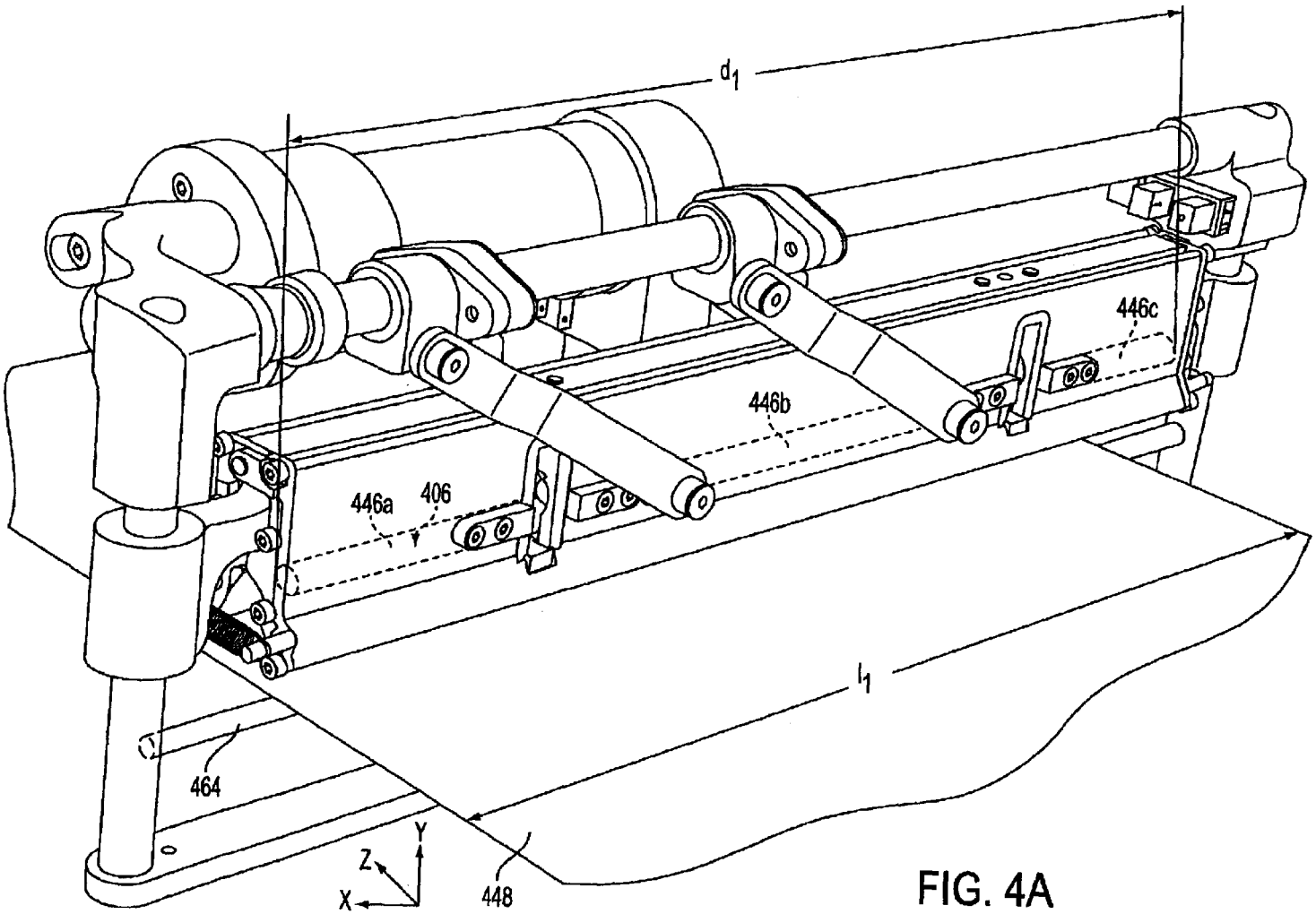
FIGS. 4A and 4B illustrate in perspective and cutaway views the sheet folding apparatus of FIGS. 1A and 1B and 3A–3C.
Figure 4B:
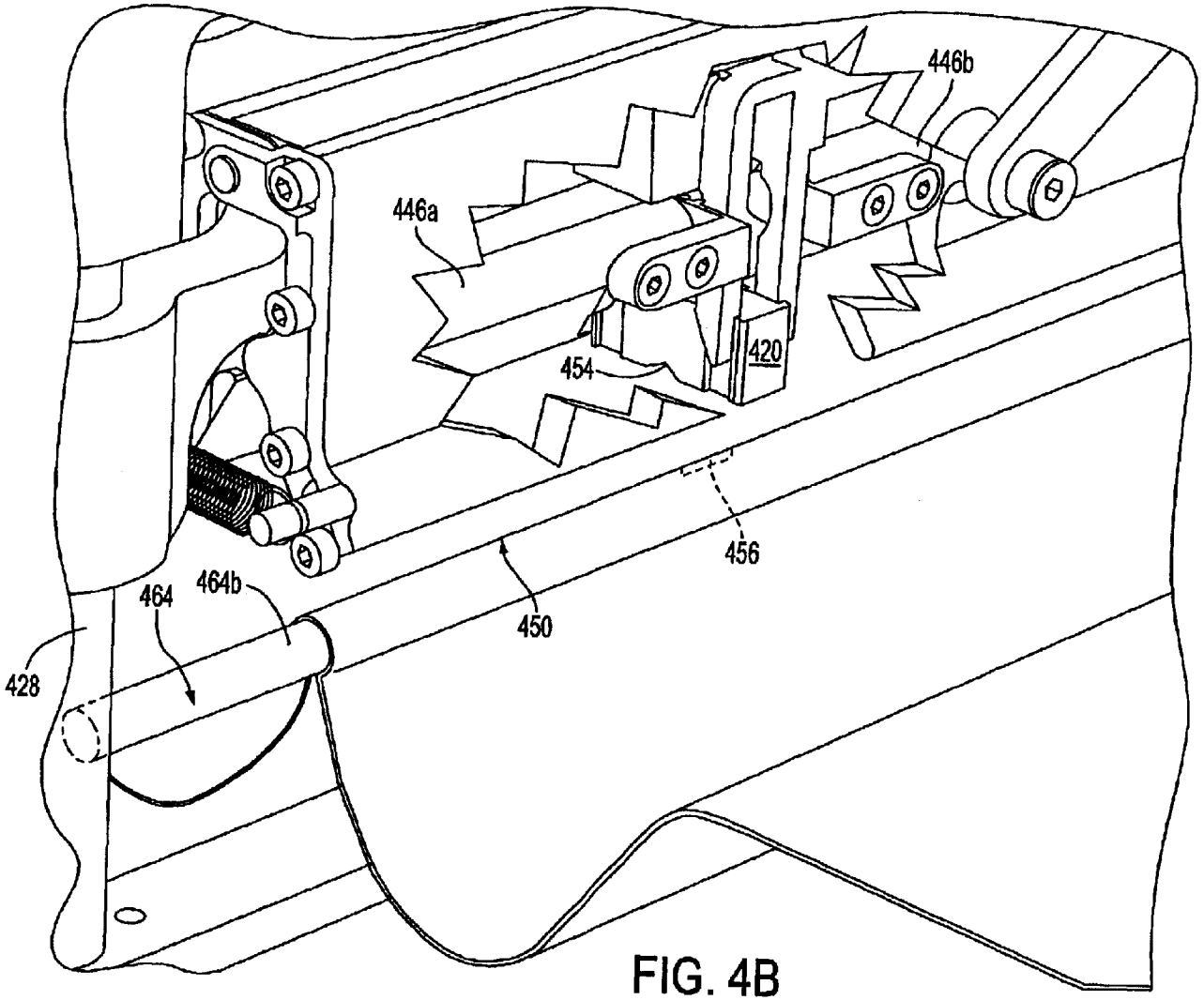

Each exemplary fold roller 106 includes multiple sub-rollers, such as in-line sub-rollers 446*a–c* in FIGS. 4A and 4B, wherein a cumulative length of the sub-rollers and spaces between the sub-rollers is at least the length of a desired fold. For example, in the FIG. 4A example, this cumulative length is represented as distance $d_1$, and includes the combined lengths of sub-rollers 446*a* . *c* and the spaces between them. Distance $d_1$ is at least as long as paper length $l_1$, which represents the length of a sheet material 448 along the longitudinal axis of fold blade 464.

A drive means, such as drive means 180 in FIGS. 1A and 1B, is provided for moving at least one of the fold blade and a fold roller into operable communication with one another such that the fold roller passes around and/or along the rounded folding surface. As referred hereon, "operable communication" means placement of the fold blade and/or the fold roller relative to one another to achieve a desired fold in a sheet material. In an exemplary embodiment, the drive means includes a coupling, such as coupling 116, and an actuator, such as lead screw 110, attached to the coupling, wherein rotation of the lead screw in a first direction is operable to move the at least one fold roller against the fold blade to create a rounded fold in a sheet material. In the examples shown in FIGS. 1A and 1B, drive means 180 includes coupling 116, lead screw 110, a motor 114, and a drive belt 132. Motor 114 can be of any conventional type (such as electric, pneumatic, or hydraulic), or can be of any other type. The exemplary lead screw 110 can be rotated by motor 114 via drive belt 132 or alternatively via any other power transmitting element, such as a chain, or can be replaced by another type of actuator, such as a piston.

Apparatus 100 also includes a housing, such as housing 102, to which the at least one fold roller is rotatably mounted, wherein the housing is attached to the coupling. In the FIG. 1B example, fold rollers 106 are attached to an interior portion of housing 102, and coupling 116 is attached to an exterior portion of housing 102. Housing 102 has a longitudinal axis in the x-axis and can be made of any formable material, such as, but not limited to, metal or plastic.

The exemplary coupling 116 includes traveling members 112, which interface with lead screw 110 through internally threaded portions and which travel along lead screw 110 upon its rotation as is known in the art. Coupling 116 also includes linking members 108, which are rotatably attached to traveling members 112 and housing 102 at pivot points $P_1$ and $P_2$, respectively, by any conventional or other pivoting means. Coupling 116 can alternatively include any other types of coupling components, such as chains or belts.

In the exemplary FIG. 1A embodiment of the present invention, drive means 180 moves the at least one fold roller along a linear path orthogonal to the sheet material to be folded. For example, due to a rotation of lead screw 110, linking members 108 rotate about pivot points $P_1$ and $P_2$ as traveling members 112 move along lead screw 110. Housing 102 is constrained along the x-axis of FIG. 1A by sliding arms 152 and rails 128, and rotation of linking members 108 causes housing 102 to move away from or towards fold blade 164 along a linear path. The combined use of lead screw 110 and coupling 116 can create very high forces in the −y-direction (i.e., towards fold blade 164) and can effectively fold sheet material ranging from, for example, conventional printer paper to heavy card stock, these examples being non-limiting. The single motion achieved by lead screw 110 and coupling 116 can alternatively be performed by other mechanical combinations, such as systems including cams, belt-and-pulleys, and gears, these examples being non-limiting.

Housing 102 includes at least one pinch foot, such as pinch feet 120, for clamping the sheet material against the fold blade, wherein the at least one pinch foot is elastically mounted to the housing. The FIG. 1B example shows two pinch feet 120, although this number can alternatively be greater or lesser. As shown in a cutaway view of housing 402 in FIG. 4B, a pinch foot 420 is positioned in a space between two sub-rollers 446*a* and 446*b*. Similarly, pinch feet 120 are shown in FIG. 1B between the sub-rollers of fold roller 106. The spaces between sub-rollers 446*a–c* can be between about 8 or 9 mm in length along the x-axis, or can be greater or lesser. Pinch foot 420 can be made of any formable material (metal and plastic being non-limiting examples) or of a deformable or elastomeric material. Pinch foot 420 can include a pinch groove 454 (FIG. 1B) to locate and hold sheet material 448 against fold blade 464; pinch groove 254 is shown to have an inverted-V cross-section shape, but can alternatively be of any other cross-section shape (e.g., hemispherical).

Housing 102 also includes fold flaps, such as two fold flaps 118, for forcing a sheet material around the fold blade. As shown in FIG. 3A, fold flaps 318 (corresponding to fold flaps 118) can be arranged to have any angle θ between them such that fold blade 363 fits between fold flaps 318 during a folding operation. Fold flaps 118 can be manufactured with housing 102 as a unitary component or separately from housing 102, and can be manufactured from the same material as housing 102 or from a different formable material. Fold flaps 118 can be pivotally attached to each other at a pivot point $P_3$ (FIGS. 3A–3C) and can also be pivotably biased towards each other by using, for example, flap springs 124. This arrangement allows the adjusting of angle θ to accommodate different sheet material thickness. Alternatively, any other elastic connecting means can be used to bias the fold flaps 118 towards one another, or fold flaps 118 can be fixedly attached to each other.

The rolling and pressing of sheet material 348 against folding surface 364*b* of fold blade 364 results in the creation of a rounded fold 350 in sheet material 348. Rounded folds in sheet material have several advantages over sharp creased folds. Whereas the pages of a sharply folded sheet tend to move apart from each other (i.e., the above-described pillowing effect), pages of a sheet with a rounded fold tend to remain closed against one another. Also, the curved shape of a rounded fold can be much more appealing both visually and tactually than a sharp fold.

FIGS. 3A–3C are exemplary illustrations of a method for folding a sheet of material to create a rounded fold. The method includes a step of feeding a sheet material into an area between at least one fold roller and a fold blade, such as feeding sheet material 348 between fold roller 306 and fold blade 364 from, for example, an upstream assembly, such as a trimming device or any other device. Sheet material 348 can, of course, be fed in the +z-direction or the −z-direction of FIGS. 3A–3C. This step illustrated in the FIG. 4A example with the feeding of sheet material 448 between fold rollers 406 and fold blade 464.

Also provided is a step of moving the at least one fold roller and the fold relative to one another to form a rounded fold in the sheet using the fold blade, wherein the fold blade includes a rounded folding surface. Housing 302 advances towards fold blade 364 by means of drive means 180 (e.g., rotation of lead screw 110 by motor 114, and movement of coupling 116). Pinch feet 420 (FIG. 4B) are used to initially secure sheet material 348 against folding surface 364*b* by engaging and pressing a portion of sheet material 348 at a location where a rounded fold 350 is to be formed against fold blade 364, thus defining a fold position. As housing 302 progresses further in the −y-direction, pinch feet 420 are forced back into housing 302 while maintaining pressure on sheet material 348 against fold blade 364, due to the action of pinch springs.

Also, before fold rollers 306 engage sheet material 348, fold flaps 318 contact sheet material 348 at portions on either side of fold blade 364 and force sheet material 348 around fold blade 364. Depending on the material properties of sheet material 348, fold flaps 318 can pivot about pivot point $P_3$ to accommodate sheet material 348. The action of forcing sheet material 348 around fold blade 364 with fold flaps 318 initiates the formation of rounded fold 350 without producing a fully-formed fold. This action also reduces the force required to initiate a rounded fold.

As shown in FIG. 3A, housing 302 is advanced to a extent such that fold rollers 306 press sheet material 348 against the top of folding surface 364*b*. A rounded fold is formed by moving two fold rollers relative to the fold blade such that the fold blade and the sheet material pass between the two fold rollers. As housing 302 continues it advancement, shown in alternate embodiments FIGS. 3B-1 and 3B-2, fold rollers 306 are forced away from each other due to the cross-sectional shape of rounded fold blade 364. In the FIG. 3B-1 example, fold rollers 306 are rotatably mounted on fold flaps 318 such that fold rollers 306 are biased towards each other. For example, fold flaps 318 are pivotably biased towards each other about pivot point $P_3$ by flap spring 324. Because fold rollers 306 are mounted onto fold flaps 318 in the FIG. 3B-1 example, they too are biased towards one another and rotate about pivot point $P_3$ when fold flaps 318 move.

Alternatively, in the FIG. 3B-2 example, fold rollers 306 are not mounted on fold flaps 318 and are biased towards each other by springs 362. In both of these embodiments, fold rollers 306 are biased towards each other (i.e., by flap spring 324 or by springs 362) and, therefore, they continue to roll against and press sheet material 348 around folding surface 364*b* as housing 302 proceeds toward rounded fold blade 364.

The FIG. 3C embodiment illustrates the position of fold rollers 306 when housing 302 has completed its advancement in the −y-direction. By the time fold rollers 306 reach this position, they have pressed sheet material 348 against a substantial amount of folding surface 364*b*. In this way, a portion of sheet material 348 conforms to the shape of fold blade 364 and thus rounded fold 350 is formed. Fold rollers 306 can press sheet material 348 against most of the surface of fold blade 364 (i.e., each fold roller 306 can travel around an 180 degree arc), depending on the size of fold rollers 306 relative to fold blade 364.

After housing 302 has completed its advancement, it retracts in the +y-direction, and the above-described process is reversed. In this way, each sheet of sheet material 348 can be pressed against folding surface 364*b* twice by fold rollers 306 to insure a rounded fold of high integrity.

As shown in FIG. 4B, a pinched portion 456 of fold 450 (i.e., that is, the area of the fold where pinch feet 420 secure sheet material 448 to fold blade 464) may not be as rounded as other portions of fold 450. This is due to the fact that sub-rollers 446*a* and 446*b* do not roll pinched portion 456 against fold blade 404 during a folding operation. Pinched portions 456 of a stack of sheet material 448 can be stapled together to form, for example, a booklet of sheets with rounded folds.

Alternatively, sheet material can be folded around a rounded fold blade with the use of a fold roller (such as fold roller 506 in the FIG. 5 example) that rotates about an axis perpendicular to a longitudinal axis of the fold blade (e.g., about the z-axis). In the exemplary FIG. 5 embodiment, fold roller 506 is rotatably mounted to a roller axle 582 that is attached to housing 502, and other similar fold rollers 506 can be positioned along the interior of housing 502 in its longitudinal axis (e.g., along the x-axis in FIG. 1A). Each fold roller 506 is formed such that its folding surface 584 is shaped to conform to fold blade 564 as a drive means moves the fold roller 506 along the longitudinal axis of fold blade 564. In this way, sheet material 548 can be deformed around fold blade 564 to create a rounded fold of a desired length.

The drive means used to move fold roller 506 can be drive means 180 (in which case, for example, fold blade 164 can be moved along rails 128 synchronously with drive means 180) or can be the drive assemblies described in the Trovinger PCT (e.g., two separate drive assemblies). Alternatively, the drive means can be any other mechanism that is capable of deforming sheet material 548 around fold blade 564 by moving fold roller along fold blade 564. Also, fold roller 506 can also be used in conjunction with pinch wheels (such as the pinch wheels disclosed in the Trovinger PCT) that include pinching surfaces which conform to the rounded periphery of fold blade 564.

It is sometimes necessary to vary certain characteristics of each individual sheet, as in the sheetwise booklet-making system, for example. In regards to the creation of a booklet with rounded folds, it is necessary to vary the shape or size of the rounded fold of each sheet. For example, the outermost or cover sheet of such a booklet may require a larger rounded fold than the rounded folds of the sheets positioned between the pages of the outmost sheet.

To adjust the size and/or shape of rounded folds, two general methods are described. In one method, the advancement of housing 302 is controlled (e.g., by a controlling unit connected to motor 114) based on individual sheet information, such as a sheet's position within a completed booklet and upon the accumulated thickness of other booklet sheets positioned between the sides of the folded sheet. For example, when a rounded fold is to be formed on a sheet that will eventually be the outermost sheet for a booklet, housing 302 may be controlled to advance such that fold rollers 306 do not press sheet material 348 against the entirety of folding surface 364*b* (e.g., sheet material 348 is only pressed to the extent shown in FIG. 3B-1 or FIG. 3B-2 before housing 302 retracts away from fold blade 364). For sheets that are to be positioned between the pages of this cover sheet, housing 302 can be advanced such that fold rollers 306 press against more of folding surface 364*b*, depending on the individual sheet information.

Figure 2A:
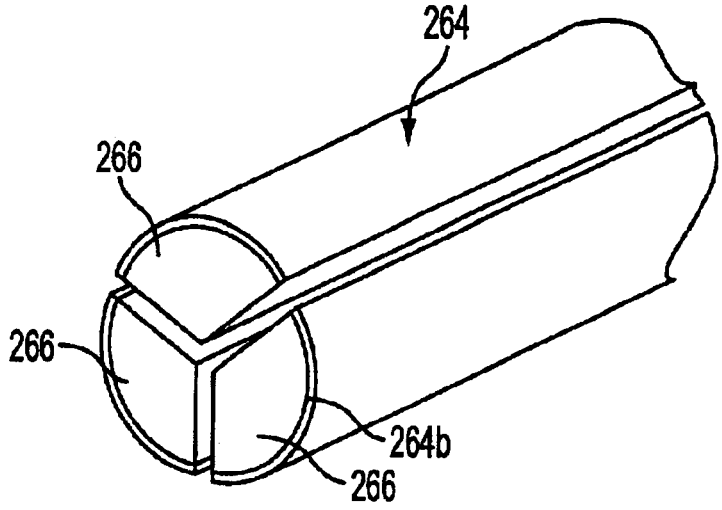
FIGS. 2A and 2B illustrate rounded fold blades with multiple blade sections in accordance with another embodiment of the present invention.
Figure 2B:
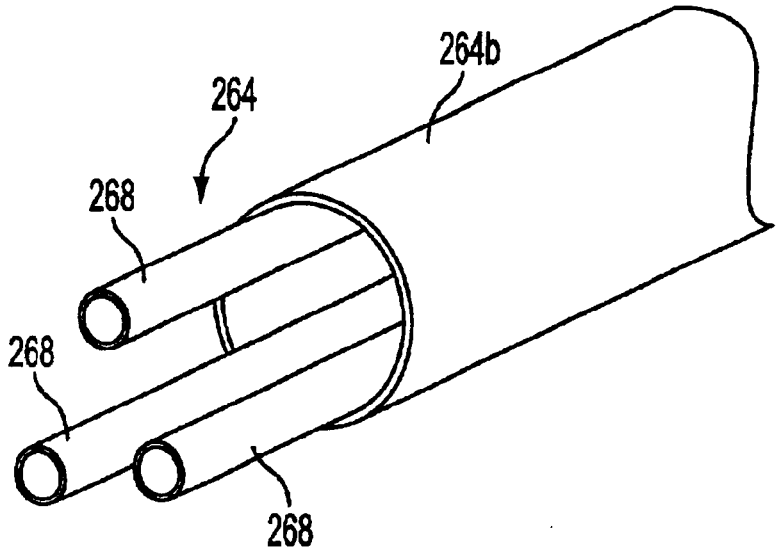

Another exemplary embodiment provides for the adjusting of the size and/or shape of a rounded folding surface. For example, a fold blade can include at least two blade sections that are movable relative to one another. FIGS. 2*a* and 2*b* illustrate perspective views of two types of multi-sectional rounded fold blades, although the present invention is not limited theses examples. Also, both of the embodiments shown in FIGS. 2*a* and 2*b* illustrate three blade sections (blade sections 266 and 268, respectively), but this number can alternatively be two or any number greater than three.

In the FIG. 2A embodiment, fold blade 264 includes separate blade sections 266, where each blade section 266 is shaped as a wedge on an interior side and is rounded on an exterior side. When the three sections 266 are positioned such that they are touching or nearly touching, the combined folding surface 264*b* can have a circular (or any other rounded) cross-sectional shape. In order to vary the size and/or shape of the effective folding surface 264*b*, blade sections 266 can be moved away from or towards one another by any conventional or other actuating means. For example, a lead screw or a wedged component can be positioned between the blade sections 266 and controlled to vary the distance between them. In the FIG. 2B embodiment, fold blade 264 includes three blade sections 268 and folding surface 264*b*, which can be an elastic material that changes shape and size as the distances between blade sections 268 are varied. Blade sections 268 can also be controlled to move by any conventional or other means. Using these exemplary embodiments, the size and/or shape of a fold blade 264 can be adjusted to produce a rounded fold in accordance with individual sheet information.

Additionally, other methods for increasing or reshaping folding surface 264*b* can be used. For example, folding surface 264*b* can be arranged as an elastic, cylindrical chamber that changes size and/or shape based on a variance of internal pressure (e.g., from fluid or gas contained and controlled within folding surface 264*b*).

Any of the exemplary embodiments can also include a step of guiding sheet material past the fold blade with a guide, such as guide 126 in the FIG. 1A example. Guide 126 can be made of any formable material and, in the FIG. 1A example, can assist the feeding of sheet material between fold blade 164 and housing 102 by guiding sheet material over fold blade 164. In other words, use of guide 126 can prevent a leading edge of a sheet material from contacting folding surface 164*b*, and thereby can prevent jamming of sheet material during a feeding step. Also, guide 126 can be arranged to pivot about pivot points $P_4$ in the x-axis such that guide 126 moves (e.g., rotates) away from fold blade 164 as a rounded fold is formed. This action prevents guide 126 from interfering with a folding process and can be accomplished with the use of a guide coupling, such as guide coupling 130, attached between housing 102 and guide 126. Alternatively, guide 126 can be arranged to move away from fold blade 164 by any other means, such as a linear translation along rails 128, as a non-limiting example. Also, guide 126 can be operable to lift folded sheet material away from fold blade 164, via guide coupling 130, as housing 102 moves away from fold blade 164.

Additionally, the method can include a step of scoring the sheet material with a scoring roller, such as scoring roller 158 shown in the FIG. 1B example. Scoring roller 158 rotates about an axis perpendicular to fold blade 164 and can be driven by a scoring motor 160. Scoring roller 158 can be configured similarly as a folding roller described in the Trovinger PCT, or can be of any alternative configuration. For example, scoring roller 158 can have a scoring surface that conforms to the rounded periphery of fold blade 164. Scoring roller 158 operates to roll a portion of a sheet material where a rounded fold is to be formed against fold blade 164 prior to a folding operation. This action creates a pre-fold in the sheet material and can be useful, for example, when folding thick sheet material by facilitating easier subsequent folding. After a scoring operation, scoring roller 158 can be moved out of the path of housing 102 to allow a folding operation. The positioning of scoring roller 158 as shown in FIG. 1B allows both scoring and folding operations without a repositioning of sheet material, as both operations are performed with the use of a shared fold blade 164.

The exemplary embodiments of the present invention provide for the creation of folds in sheet material that are functionally advantageous to (and more aesthetically pleasing than) sharply creased folds. Exemplary embodiments of the present invention can be modified to include features from any or all of the following copending applications, all filed on even date herewith, the disclosures of which are hereby incorporated by reference in their entirety: Sheet Folding Apparatus With Pivot Arm Fold Rollers, Ser. No. 09/970,877; Sheet Folding Apparatus, Ser. No. 09/970,730; Thick Media Folding Method, Ser. No. 09/970,748; and Variable Media Thickness Folding Method, Ser. No. 09/971,351.

It will be appreciated by those skilled in the art that the present invention can be embodied in other specific forms without departing from the spirit or essential characteristics thereof. The presently disclosed embodiments are therefore considered in all respects illustrative and not restricted. The scope of the invention is indicated by the appended claims rather than the foregoing description and all changes that come within the meaning and range and equivalence thereof are intended to be embraced within.

What is claimed is:

1. A method for folding a sheet of material, comprising the steps of:

feeding a sheet material into an area between a fold roller and a fold blade, the fold roller comprising at least two fold roller elements biased toward each other in a first plane, the fold blade having a longitudinal axis in a first direction and the fold blade having a shape that includes a rounded folding surface; and moving the fold roller and the fold blade relative to one another to form a rounded fold in the sheet, wherein the longitudinal axis of the fold blade moves from a first position vertically below an axis of the fold rollers to a second position vertically above the axis of the fold rollers, the fold rollers move along a circumferential surface of the rounded folding surface, and wherein the rounded folding surface is adjustable and the method comprises the step of adjusting at least one of a size and the shape of the rounded folding surface to change a perimeter of the rounded fold blade.

2. The method of claim 1, wherein the step of adjusting is based on a position in a booklet that the sheet material occupies.

3. The method of claim 1, wherein each fold roller comprises:

multiple sub-rollers, wherein a cumulative length of the sub-rollers and spaces between the sub-rollers is at least the length of the rounded fold.

4. The method of claim 1, wherein the feeding step comprises:

guiding the sheet material past the fold blade with a guide.

5. An apparatus for folding sheet material, comprising:

a fold blade having a shape that includes a rounded folding surface and a major axis in a first direction;

at least two fold rollers, wherein each fold roller has a contacting surface and a major axis in the first direction and a plane contains the major axis of the first fold roller and the major axis of the second fold roller; and drive means for moving at least one of the fold blade and the plurality of fold rollers into operable communication such that the major axis of the fold blade moves from a first position vertically below the major axes of the fold rollers to a second position vertically above the major axes of the fold rollers, while simultaneously the contacting surface of the two fold rollers maintain a pressure against the rounded fold surface of the fold blade to form a rounded fold in the sheet material, wherein at least one of a size and a shape of the rounded folding surface is adjustable.

6. The apparatus of claim 5, wherein the major axis of the fold blade is a longitudinal axis and the major axis of the fold rollers is parallel to the major axis of the fold blade.

7. The apparatus of claim 5, wherein the two fold rollers are biased towards one another.

8. The apparatus of claim 5, comprising:

two fold flaps for forcing a sheet material around the fold blade.

9. The apparatus of claim 8, wherein the fold flaps are biased towards each other.

10. The apparatus of claim 8, wherein the fold rollers are rotatably mounted on the fold flaps such that the fold rollers are biased towards each other.

11. The apparatus of claim 5, wherein the fold blade is positioned in a plane which passes between the two fold rollers.

12. The apparatus of claim 5, wherein each fold roller comprises:

multiple sub-rollers.

13. The apparatus of claim 5, wherein the fold blade includes at least two blade sections that are movable relative to one another to increase a perimeter of the rounded fold blade.

14. The apparatus of claim 9, wherein the fold flaps are pivotably biased towards each other.

15. The apparatus of claim 5, wherein the rounded folding surface is adjustable to change a perimeter of the rounded fold blade.

16. The apparatus of claim 13, wherein the at least two blade sections are movable relative to one another to increase a perimeter of the rounded fold blade based on a position the sheet material occupies in an assembled booklet.

17. The apparatus of claim 15, wherein the rounded folding surface is adjustable to change a perimeter of the rounded fold blade based on a position the sheet material occupies in an assembled booklet.

* * * * *